United States Patent [19]

Kulus et al.

[11] Patent Number: 4,937,607

[45] Date of Patent: Jun. 26, 1990

[54] APPARATUS AND METHOD FOR PROCESSING PHOTOSENSITIVE SHEETS

[75] Inventors: Richard W. Kulus, Minneapolis; David M. Webb, Blaine; John P. Markey, New Hope, all of Minn.

[73] Assignee: Pako Corporation, Minneapolis, Minn.

[21] Appl. No.: 246,860

[22] Filed: Sep. 20, 1988

[51] Int. Cl.[5] ..... G03D 3/02; G03D 3/08

[52] U.S. Cl. ..... 354/320; 354/324

[58] Field of Search ..... 354/320, 321, 322, 324, 354/328, 331, 338, 339; 134/64 P, 122 P

[56] References Cited

U.S. PATENT DOCUMENTS 3,532,048 10/1970 Hope et al. ..... 354/320

4,312,585 1/1982 Otsu et al. ..... 354/324

*Primary Examiner*—A. A. Mathews

*Attorney, Agent, or Firm*—Kinney & Lange

[57] ABSTRACT

A processor for photosensitive sheet material which allows uniform initial exposure of the sheet material to developer solution. The processor includes a channel defined by an initial roller pair submerged in developer tank, third and fourth rollers above the rollers of the pair. The channel runs horizontally in the processor and has a stream of developer. The sheet to be developed travels downward through the stream and through the nip of the initial roller pair.

22 Claims, 3 Drawing Sheets

APPARATUS AND METHOD FOR PROCESSING PHOTOSENSITIVE SHEETS

BACKGROUND OF THE INVENTION

The present invention relates to a processing apparatus for photosensitive material and specifically to a trough for exposing a moving sheet of photosensitive material to a stream of liquid developing solution.

DESCRIPTION OF THE PRIOR ART

The processing of photosensitive materials typically requires that the materials be saturated with various development chemicals. Once a sheet of photosensitive material has been exposed to such chemicals, it then must be dried for use in creating prints and copies of the image borne thereon.

Photosensitive material processors have been developed which feed a sheet of photosensitive material through the necessary chemicals in an orderly fashion and then dry the sheet for further use. Typically, the sheet is driven by engagement with various rollers or matched roller pairs to follow a desired processing path. Each sheet of photosensitive material will bear one or more unique photographic images, which are often incapable of being reproduced in exactly the same form. Thus, great care must be used in handling such sheets.

In many cases, the sheet of photosensitive material to be processed is in the form of a roll or a long sheet. In other cases, the sheet is more nearly square. In both cases, as the sheet is fed through the processor, portions of the sheet successively contact the chemical solutions along the processing path. The path is typically serpentine in nature, so that the sheet can be dipped in tanks of various processing chemicals as it passes along the processing path.

One of the most critical periods in processing of the photosensitive material is the initial contact or exposure with the development solution. The uniformity of initial contact of photosensitive material development depends, in part, upon having a consistent concentration of developing solution. Four factors primarily determine the uniformity and therefore the quality of initial exposure to developing solution: temperature, rate of immersion, agitation, and concentration. Currently available processors provide adequate control of rate of immersion, through the use of matched roller pairs. Temperature is controlled adequately by temperature control systems.

Typically, however, control of concentration of developing chemistry adjacent the emulsion has been inadequate. One approach to maintaining a uniform concentration within the developer tank has been constant feed and removal of liquid from the reservoir of solution in the developing tank. The constant feed and removal promotes uniform concentrations of chemicals within the tank. However, the constant replacement of solution within the bath has been inadequate to deal with local fluctuations and concentration gradients immediately adjacent to the emulsion of the photosensitive material. The fluctuations of concentration of developing chemical result in an undesirable development artifact known in the industry as "mottling" which is best described as irregularly shaped areas of enhanced and diminished image density on the product. Another development artifact to be avoided is mechanical damage to the rather soft emulsion side of the sheet. Various recirculation methods have also been somewhat inadequate to prevent local concentration gradients without creating turbulence which is detrimental to uniform development.

SUMMARY OF THE INVENTION

The present invention is a liquid holding trough for use in processing a downward traveling sheet of photosensitive film. The trough includes a first end, a second, and a channel extending from the first end to the second end. The channel is defined by a portion of a first generally horizontal roller and a portion of a second generally horizontal roller parallel and adjacent to the first roller and forming a nip with the first roller and a boundary means for directing a liquid stream generally horizontally across the face of a sheet in the pathway and perpendicular to the direction of sheet travel. Preferably, the boundary means include a third roller parallel to, adjacent and above the first roller and a fourth roller parallel, adjacent and above the second roller. Liquid developer solution is introduced into the channel adjacent the first end and exits the channel in several ways. First, the liquid may exit the channel through a port adjacent the second end. Second, the liquid may alternatively exit the channel from a gap between the first and third rollers. Alternatively, liquid may exit the channel through both the gap and the port adjacent the second end. Further, liquid may exit the channel by escaping over the top of the trough.

DETAILED DESCRIPTION OF THE PREFERRED EMBODIMENTS

Figure 1:
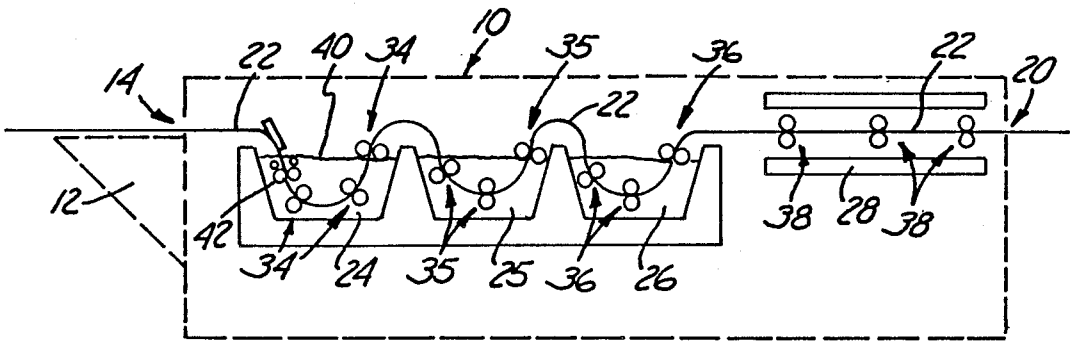
FIG. 1 is a schematic representation of the path of photosensitive sheets through a processor including the present invention.

In FIG. 1, a processor of this invention is schematically shown at 10. The processor 10 has a feed table 12 upon which sheets of photosensitive material are fed into the processor 10 through an entrance opening 14. The processor 10, or at least the feed table 12 and entrance opening 14, are located in a "dark room" to avoid light exposure of the sheets of photosensitive material being fed into the processor 10. Preferably, the remaining portions of the processor 10 are located on the opposite side of a wall (not shown) from the front end of the processor 10. The remainder of the processor does not have to be maintained in darkness, and the room in which the remainder of the processor 10 is located is preferably a "light room" rather than a "dark room".

Photosensitive sheets which have entered into the entrance opening 14 are transported through the processor 10 and are eventually driven out a rear end thereof through an opening 20.

During processing, the photosensitive sheets follow a photosensitive sheet processing path 22 passing between a plurality of roller pairs located in various processing stations such as processing liquid tanks 24, 25, 26 and dryer portion 28 of the processor 10. The various roller pairs form a transport system for transporting sheets of photosensitive material through the processor 10 and define the sheet processing path 22 which extends from a first end of the processor (near entrance opening 14) to a second end thereof (near the exit opening 20). In a typical photo processor, liquid tank 24 contains developer solution, liquid tank 25 contains fix solution and liquid tank 26 contains wash solution. A photosensitive sheet is thus sequentially passed through developer, fix and wash solutions to chemically process and develop the photographic images borne thereon. The sheet is then immediately passed through a dryer portion in the processor where tempered air is directed at the sheet from both sides so that the sheet is immediately dried for additional handling (e.g. printing of the images thereon).

As mentioned, the transport system for transporting the sheets of photosensitive material through the processor 10 includes a plurality of roller pairs—roller pairs 34 within the developer tank 24, roller pairs 35 within the fix tank 25, roller pairs 36 within the wash tank 26 and roller pairs 38 within the drier portion 28. Each roller pair consists of two drive rollers which are disposed laterally across the photosensitive sheet processing path 22 with the nip between each pair of rollers serving to define a portion of the path 22. Travel of a sheet along the path 22 is from the entrance opening 14 to the exit opening 20 (i.e. from left to right as viewed in FIG. 1). The roller pairs 34, 35, 36 and 38 are rotatably driven and engage each sheet of photosensitive material to move it along the sheet processing path. A suitable arrangement for the driving the various roller pairs is shown in U.S. Pat. No. 4,673,251, incorporated herein by reference.

Figure 2:
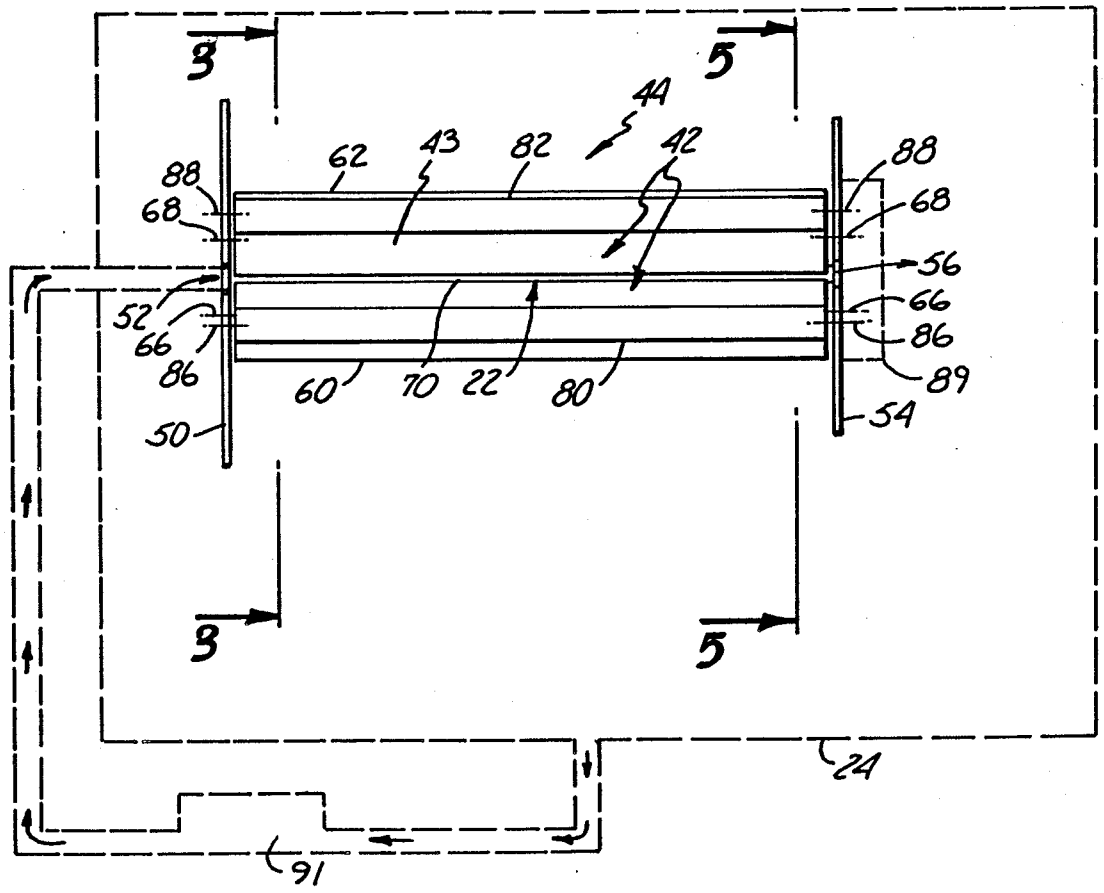
FIG. 2 is a top view of the channel portion of FIG. 1.

Within the development tank 24, a critical portion of the developing process occurs from the liquid boundary 40 through the first pair of submerged rollers 42. In FIG. 2, a top view of the initial roller pair 42 is shown. Each roller of the initial roller pair 42 is supported by a first end plate 50 including a inflow port 52 and a second end plate 54 including an outflow port 56. Extending between the first end plate 50 and the second end plate 54 are the initial roller pair 42, specifically a first roller 60 and a second roller 62. The first roller 60 has an axis 66 which is generally horizontal with respect to the top surface of developer in the developer tank 24. The second roller 62 has an axis 68 and is also generally horizontal with respect to the developer in the developing tank 24, and is parallel and adjacent to the first roller 60. A nip 70 is created by and between the adjoining surfaces of the first roller 60 and the second roller 62.

A third roller 80 has an axis 86 and in a first embodiment is generally parallel and adjacent to the first roller 60. The axis 86 of the third roller 80 lies generally above the axis 66 of the first roller 60. A fourth roller 82 has an axis 88 and lies generally parallel and adjacent to a second roller 62. The axis 88 of the fourth roller 82 lies generally above the axis 68 of the second roller 62. (See FIG. 3). Together, the initial roller pair 42, third roller 80, and fourth roller 82 form a channel 43 for directing a stream of developer solution from the first end plate 50 to the second end plate 54. In combination with the channel 43 and ends 50 and 54, a trough 44 is defined.

The nip 70 forms a portion of the path 22 of the sheet being processed with the sheet traveling generally downward through the nip 70. Developing solution enters the trough 44 at the entrance port 52 of the first end plate 50 and has a bulk flow parallel to the face of any sheet passing downward through the nip 70, finally flowing out of the trough 44 at an port 56 in the second end plate 54. The bulk flow of the stream of liquid from port 52 to port 56 is generally perpendicular to the direction of sheet travel downward along path 22 (of FIG. 1) through the nip 70. Additionally, the four rollers 60, 62, 80 and 82 are synchronously driven by a suitable driving means 89 as shown in phantom in FIG. 2. Also shown in phantom is a pump means 91 recirculating developer solution in the tank 24. A "make up" circuit may also be present to supplement the reservoir concentration of developer.

By synchronous rotation of the rollers is meant that the first roller 60 and the second roller 62 rotate such that the surfaces of the two rollers 60 and 62 generally meet at the nip 70 and provide a substantially uniform downward motion to any sheet of photosensitive material traveling the path 22. Specifically, neither roller surface moves substantially faster than the other. Similary, the third roller 80 and the fourth roller 82 move in a similarly sychronous manner with respect to the first and second rollers 60 and 62.

Figure 3:
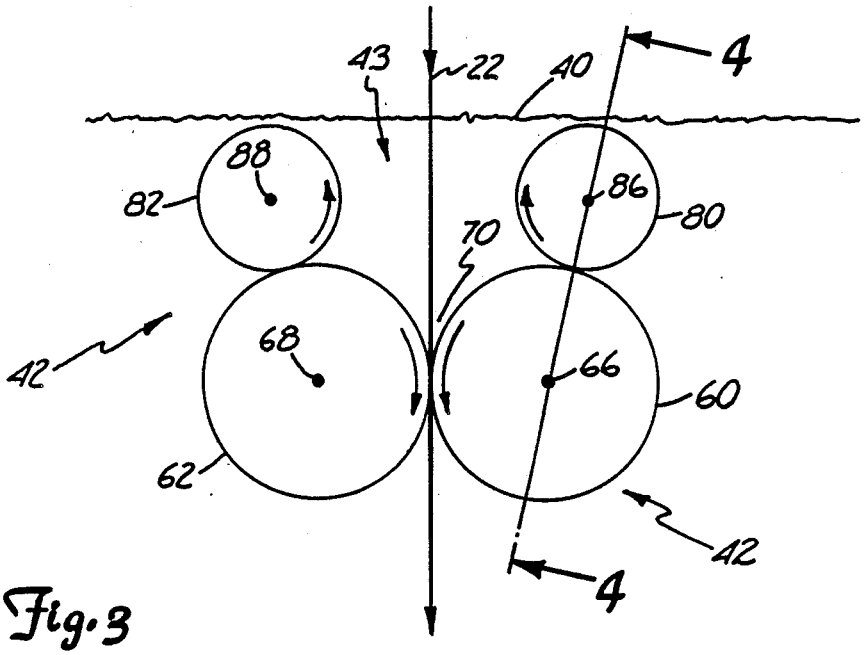
FIG. 3 is a sectional view of the channel at 3—3 of FIG. 2.
Figure 5:
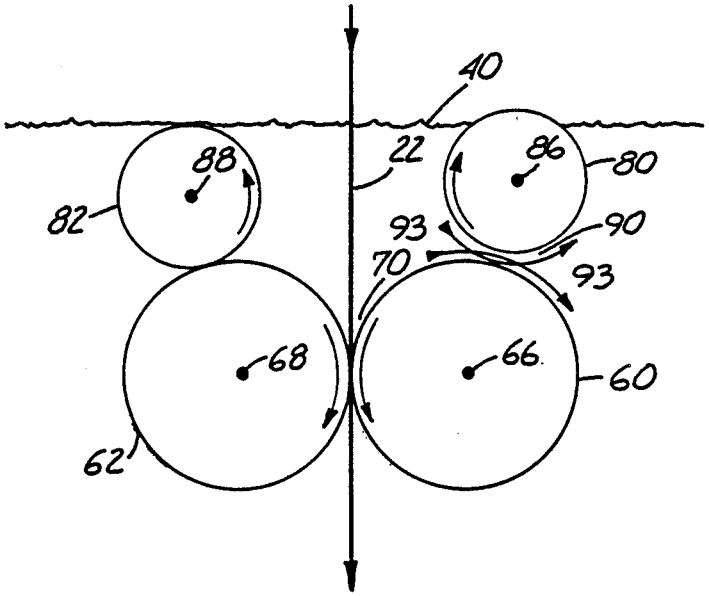
FIG. 5 is a sectional view of the channel at 5—5 of FIG. 2.

In FIG. 3, the first roller 60 is shown adjacent to the second roller 62 along with the nip 70. The nip 70 forms a portion of the pathway 22 of the sheet through the developing tank 24 (of FIG. 1). The third roller 80 is generally above and adjoining the first roller 60. The fourth roller 82 is generally above and adjoining the second roller 62. The four rollers 60, 62, 80 and 82 together define the channel 43 which, in combination with the end plates 50 and 52, define the trough 44. The third roller 80 and the fourth roller 82 each have an upper surface near the liquid surface 40 within the development tank 24. The third and fourth rollers 88 serve as a channel defining means and direct the stream of developing solution horizontally in the processor 10. Preferably, the third and fourth rollers 80 and 82 are formed of stainless steel.

Preferably a photosensitive sheet traveling the path 22 is arranged such that the emulsion side of the sheet contacts the first roller 60 and the base side opposite the emulsion side) of the sheet contacts the second roller 62. The second roller 62 is preferably formed of resilient soft elastomer material, while the first roller 60 is preferably formed of a hard material with a smooth, polished surface. Together the first roller 60 and the second roller 62, due to their respective surfaces and materials, provide an constant, gentle pressure on a sheet of photosensitive material traveling the path 22. Any uneven pressure exerted by the somewhat rougher surface of the soft elastomer material of the second roller 62 is applied to the more durable base side of the photosensitive material. In contrast, the polished surface of the first roller 60 provides an extremely constant, gentle pressure to the rather delicate emulsion side of the photosensitive material. Further, due to the resilient sponge material of the second roller 62, the nip 70 remains essentially closed in the absense of a sheet of material traveling through the pathway 22.

Figure 4:
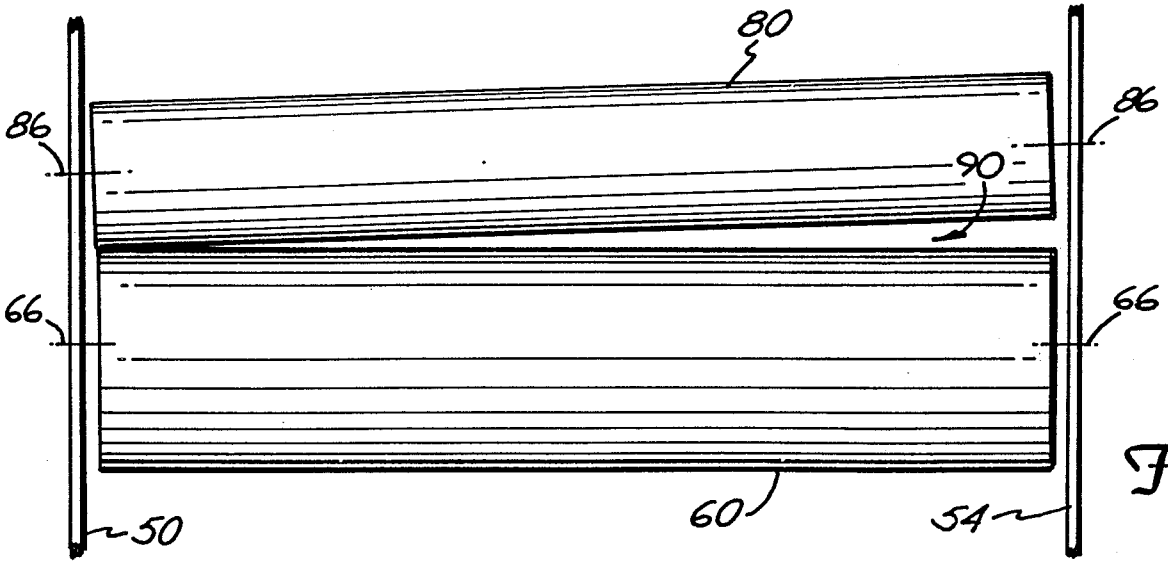
FIG. 4 is a view of a portion of the channel of the embodiment at 4—4 of FIG. 3.

In FIG. 4, another feature of the invention is shown. The third roller 80 may be arranged with a slight separation or gap 90 with the first roller 60. The gap 90 allows a controlled portion 93 of the flow within the channel 42 of the trough 44 to be released (as shown in FIG. 4). In a most preferred embodiment, the gap 90 (as shown in FIG. 4) is formed by canting the axis 86 of the second roller 80 with respect to the axis 66 of the first roller 60. The cant or angle between the two axes 66 and 86 is generally small, for example from about zero to about two hundred thousands of an inch for a processor having a 48 inch wide sheet capacity. Other processors of widths such as 26 inches or 38 inches may have similar angles. Adjustment of the angle between the axes 66 and 86 may be accomplished by means of an assortment of spacers or shims inserted in a hub mount for the spindle defining the axis 86 of the third roller 80. Alternatively, an easily adjustable cant or angle may be formed by an adjustment thread or a sliding lock arrangement between third roller 80 and end plates 50 and 54.

The gap 90 increases in width with increasing distance from the input port 52. Such an arrangement is highly effective in removing an increasing portion of the developer solution from the channel 43 with increasing distance from the input port 52. Effectively, the discharge of developer solution through the gap 90 allows for replacement of spent or depleted developer solution with fresh developer solution. Replacement of spent solution with fresh developer, of a desired concentration promotes uniformity of concentration along the entire channel 42 of the trough. In turn, liquid developer contact of a sheet to be developed occurs uniformly over all areas of the sheet and developing artifacts are generally avoided.

Another feature of the present invention is the location of the gap 90 perferably on the emulsion side of the photosensitive sheet to be processed in the path 22. Such an orientation of location of the gap 90 is more efficient than a gap located on the base side of the photosensitive material since depletion of desired developer concentration occurs almost strictly on the emulsion side of the path 22.

Alternative gap 90 arrangements and roller designs which provide gaps are also envisioned as part of the present invention. For example, a gap 90 having a constant width may be employed, however, adjustment of such a gap typically would require adjustment on both ends of the third roller 80. Additionally, a roller 80 with a non-cylindrical surface, such as a tapered or frustoconical surface might be employed to provide a more complex yet still adjustable gap 90.

Additionally, the stream flow may also be further altered by plugging the main exit port 56 in the second end 54. Such a modification requires a generally larger gap 90 since the liquid would then exit the trough 44 through the gap 90.

In general, the present invention is also a horizontal channel within a processor which is serving as a boundary of a stream of developer. Alternative boundary means such as sheets or blocks of inert materials are also envisioned by the inventors as possible for defining a channel boundary. The stream is the initial point of developer solution contact for a photosensitive material to be developed. The stream promotes a uniform developer concentration immediately adjacent the face of the sheet and also flushes away detrimental by-products of developing.

The present invention is also a method for uniformly exposing sequential portions of a sheet of photosensitive material to a developing solution. This is a critical period in developing photosensitive materials. The method includes the steps of providing a generally horizontally directed stream of developing solution and passing the sheet to be developed downward through the stream with the sheet oriented such that the stream flow is parallel to the faces of the sheet. In a preferred embodiment, the stream is within a channel, as described previously and the initial pair of rollers defining the channel are rotating. The sheet travels downward, with the leading edge first crossing the surface of the developer in the stream and later exiting through the nip between the first and second rollers. The final product is reviewed for development artifacts and the gap adjusted as needed to minimize any artifacts which are observed. The rotation of rollers defining the channel effectively means that the channel has generally defined boundaries but lacks stationary surfaces. The moving surfaces of the rollers impart secondary flows within the stream which further promote uniformity of developer concentration at the emulsion, while avoiding turbulence. Thus, the method of this invention results in excellent developed products.

The method of the present invention is particularly suited to developing of new high contrast rapid access lith processes but is generally applicable to all developing processes in which uniform initial contact of photosensitive materials with developing solutions is critical to avoiding development artifacts.

Although the present invention has been described with reference to preferred embodiments, workers skilled in the art will recognize that changes may be made in form and detail without departing from the spirit and scope of the invention.

What is claimed is:

1. A liquid holding trough for use in processing a downward traveling sheet of photosensitive film comprising:
   - a first end;
   - a second end;
   - a channel extending from the first end to the second end, the channel defined by:
     - a portion of a first generally horizontal roller;
   - a portion of a second generally horizontal roller extending parallel to and adjacent to the first roller with a nip between the first and second rollers defining, in part, a pathway for the sheet through the trough, wherein the first and second rollers are an initial pair of submerged rollers in a development tank; and
   - boundary means, extending from near the initial pair to near a surface of a liquid in the tank, for directing a stream of liquid parallel to the first and second rollers, the boundary means including a first boundary member positioned above and generally parallel to the first roller and a second boundary member positioned above and generally parallel to the second roller.

2. The trough of claim 1, further comprising:
   - means for introducing liquid adjacent the first end; and
   - means for removing liquid.

3. The trough of claim 2 wherein the means for removing liquid includes a port adjacent the second end of the trough.

4. The trough of claim 2 wherein the means for removing liquid includes a gap between the first roller and the boundary means for directing a stream.

5. A liquid holding trough for use in processing a downward traveling sheet of photosensitive film comprising:
   - a first end;
   - a second end;
   - means for introducing liquid adjacent the first end;

means for removing liquid; and a channel extending from the first end to the second end, the channel defined by:

a portion of a first generally horizontal roller;

a portion of a second generally horizontal roller extending parallel to and adjacent to the first roller with a nip between the first and second rollers defining, in part, a pathway for the sheet through the trough; and boundary means for directing a stream of liquid parallel to the first and second rollers; and wherein the means for removing liquid includes a gap between the first roller and the boundary means for directing a stream and wherein the gap increases in width from adjacent the first end to adjacent the second end.

6. The trough of claim 5 wherein the boundary means includes a third roller adjacent to the first roller and separated from the first roller by the gap.

7. A liquid holding trough for use in processing a downward traveling sheet of photosensitive film comprising:

a first end;

a second end;

a channel extending from the first end to the second end, the channel defined by:

a portion of a first generally horizontal roller;

a portion of a second generally horizontal roller extending parallel to and adjacent to the first roller with a nip between the first and second rollers defining, in part, a pathway for the sheet through the trough, wherein the first and second rollers are an initial pair of submerged rollers in a development tank; and boundary means, extending from near the initial pair to near a surface of a liquid in the tank, for directing a stream of liquid parallel to the first and second rollers, wherein the boundary means include a third roller, substantially parallel to and adjacent to an upper surface of the first roller.

8. The trough of claim 7 wherein the boundary means include a fourth roller substantially parallel to and adjacent to an upper surface of the second roller.

9. A liquid holding trough for use in processing a downward traveling sheet of photosensitive film comprising:

a first end;

a second end;

a channel extending from the first end to the second end, the channel defined by:

a portion of a first generally horizontal roller;

a portion of a second generally horizontal roller extending parallel to and adjacent to the first roller with a nip between the first and second rollers defining, in part, a pathway for the sheet through the trough;

boundary means for directing a stream of liquid parallel to the first and second rollers;

wherein the boundary means include a third roller, substantially parallel to and adjacent to the upper surface of the first roller; and wherein the first roller engages the third roller.

10. A liquid holding trough for use in processing a downward traveling sheet of photosensitive film comprising:

a first end;

a second end;

a channel extending from the first end to the second end, the channel defined by:

a portion of a first generally horizontal roller;

a portion of a second generally horizontal roller extending parallel to and adjacent to the first roller with a nip between the first and second rollers defining, in part, a pathway for the sheet through the trough; and boundary means for directing a stream of liquid parallel to the first and second rollers; wherein the boundary means include a third roller substantially parallel to and adjacent to an upper surface of the first roller and a fourth roller substantially parallel to and adjacent to an upper surface of the second roller; and wherein the first roller engages the third roller and the fourth roller engages the second roller.

11. The trough of claim 10 wherein the first and second rollers rotate such that the surfaces of the rollers match the speed and direction of the traveling web at the nip.

12. The trough of claim 11 wherein the third roller contacts the first roller and the surfaces of the first and third rollers match in speed and direction and the fourth roller contacts the second roller and the surfaces of the second and fourth rollers match in speed and direction.

13. A liquid holding trough for use in processing a downward traveling sheet of photosensitive film comprising:

a first end;

a second end;

a channel extending from the first end to the second end, the channel defined by:

a portion of a first generally horizontal roller;

a portion of a second generally horizontal roller extending parallel to and adjacent to the first roller with a nip between the first and second rollers defining, in part, a pathway for the sheet through the trough; and boundary means for directing a stream of liquid parallel to the first and second rollers, wherein the boundary means include a third roller substantially parallel to and adjacent to an upper surface of the first roller and a fourth roller substantially parallel to and adjacent to an upper surface of the second roller, and wherein the third roller is angled with respect to the first roller, thereby defining a gap for outflow of liquid.

14. A processor of photosensitive sheet materials comprising:

a developing tank within the processor for containing a photodeveloping solution, the tank having an open top;

a channel in the developing tank, the channel allowing initial contact of a downward traveling photosensitive sheet material to be developed with a generally horizontally directed stream of photodeveloping solution, the channel defined in part by boundary means for directing a stream of photodeveloping solution generally horizontally within the developing tank above an initial submerged roller pair of the processor, the boundary means including first and second generally parallel boundary members positioned above the initial submerged roller pair between the roller pair and a liquid surface in the developing tank.

15. The processor of claim 14 further comprising: means for moving developer solution.

16. The process of claim 15 wherein the means for moving include a pump.

17. The processor of claim 14 wherein the first and second boundary members are first and second horizontal rollers and further comprising: means for rotating the first and second rollers.

18. The processor of claim 17 wherein the means for rotating is an electric motor.

19. A method for uniformly exposing sequential portions of a sheet of photosensitive material to a developing solution comprising:

providing a generally horizontally directed stream of the developing solution within a channel near the liquid surface of a developing tank wherein the channel is defined by:

a portion of a first generally horizontal roller;

a portion of a second generally horizontal roller extending parallel to and adjacent to the first roller with the nip between the first and second rollers defining, in part, a pathway for the sheet through the trough;

a first boundary member positioned between an upper surface of the first roller and the liquid surface; and a second boundary member positioned between an upper surface of the second roller and the liquid surface;

passing the sheet downward across the surface of the liquid in the stream, through the stream, and exiting the stream at the bottom, the downward traveling sheet oriented such that the faces of the sheet are parallel to the direction of the stream.

20. The method of claim 19 wherein the sheet exits the stream through the nip between the first and second rollers.

21. The method of claim 19 wherein the rollers defining the stream are rotating.

22. A liquid holding trough for use in processing a sheet of photosensitive film comprising:

a first end;

a second end;

an open-top channel extending from the first end to the second end, the channel defined by:

a first surface;

a second surface adjacent to the first surface;

boundary means extending from the first and second surfaces for directing a stream of liquid parallel to the first and second surfaces; and wherein the channel lacks any stationary surfaces.

* * * * *

UNITED STATES PATENT AND TRADEMARK OFFICE

CERTIFICATE OF CORRECTION

PATENT NO. : 4,937,607

DATED : June 26, 1990

INVENTOR(S) : Richard W. Kulus et al.

It is certified that error appears in the above-identified patent and that said Letters Patent is hereby corrected as shown below:

On the title page;

In the References Cited Section, under U.S. PATENT DOCUMENTS, add the following:

4,673,251 6/1987 Sannel . . . . . 354/322

In the References Cited Section, insert the following:

OTHER PUBLICATIONS

Pako 26RT Manual, Page 4, November, 1987

Pako 48RA Series 700 Manual, November, 1987

Col. 8, line 41, delete "rollers," insert --rollers; and--

UNITED STATES PATENT AND TRADEMARK OFFICE

CERTIFICATE OF CORRECTION

PATENT NO. : 4,937,607

DATED : June 26, 1990

INVENTOR(S) : Richard W. Kulus, et al

It is certified that error appears in the above-identified patent and that said Letters Patent is hereby corrected as shown below:

Col. 9, line 7, after "rollers", insert --, respectively,--

Signed and Sealed this

Thirteenth Day of August, 1991

*Attest:*

HARRY F. MANBECK, JR.

*Attesting Officer*

*Commissioner of Patents and Trademarks*